US005542250A

United States Patent [19]

Ball et al.

[11] Patent Number: 5,542,250

[45] Date of Patent: Aug. 6, 1996

[54] METHOD AND APPARATUS FOR ACTUATING A DIRECT SOURCE EXHAUST GAS CAPTURE SYSTEM

[76] Inventors: Gordon M. Ball, 1037 Cornwell Ave., Baldwin Harbor, N.Y. 11510; Lawrence M. Sears, 45006 Mather La., Hunting Valley, Ohio 44022

[21] Appl. No.: 318,219

[22] Filed: Oct. 5, 1994

[51] Int. Cl.[6] ..... F02B 35/00; F24F 7/00

[52] U.S. Cl. ..... 60/315; 454/63

[58] Field of Search ..... 60/315; 454/63, 454/64

[56] References Cited

U.S. PATENT DOCUMENTS

| | | | |
|---|---|---|---|
| 5,092,228 | 3/1992 | Pfeiffer | 454/63 |
| 5,155,995 | 10/1992 | Kinnear | 60/300 |
| 5,362,273 | 11/1994 | Pfeiffer | 454/63 |

OTHER PUBLICATIONS

Advertising Brochure #13–3 entitled "Nederman Magnatrack Exhaust Extraction System for Emergency Vehicles".

Advertising Brochure entitled "Nederman Clean Air Systems," copyright 1990.

Advertising Brochure #12–9 entitled "Nederman Overhead Exhaust Extraction Rails for Moving Vehicles".

Advertising Brochure #10–Z entitled "Nederman".

Advertising Brochure #1305.14 entitled "Nederman Magna System".

Tykron Advertising Brochure entitled "Breathe Easy with Tykron Source Extraction Products".

Specifications for Carbon Monoxide Exhaust System, Group H2M.

*Primary Examiner*—Douglas Hart

[57] ABSTRACT

A method and apparatus for actuating a direct source exhaust gas capture system for capturing and exhausting exhaust from a vehicle tailpipe which automatically starts when the ignition system of the vehicle is actuated prior to the engine starting, and which is operable to automatically restart when the vehicle returns to the vehicle storage facility.

43 Claims, 3 Drawing Sheets

METHOD AND APPARATUS FOR ACTUATING A DIRECT SOURCE EXHAUST GAS CAPTURE SYSTEM

DESCRIPTION—TECHNICAL FIELD

The present invention relates to a method and apparatus for actuating a direct source exhaust gas capture system for capturing and exhausting fumes from a vehicle tailpipe when the vehicle is located at a vehicle storage facility. The system includes an exhaust gas hose for attaching to the vehicle tailpipe, an exhaust fan connected to the hose for exhausting exhaust fumes from the vehicle tailpipe through the hose, a means for energizing the exhaust fan, transmitter means associated with the vehicle for generating a first signal when the electrical system of the vehicle is energized and the engine of the vehicle is running, and a receiver for actuating the means for energizing the exhaust fan in response to the receiver receiving the first signal. The transmitter means generates the first signal when the ignition system is energized and prior to the engine of the vehicle starting to thereby allow the exhaust fan to be running prior to the engine running when the engine of the vehicle is started.

BACKGROUND OF THE INVENTION

Direct source exhaust gas capture systems are known for capturing exhaust fumes from a vehicle. These systems are generally utilized for emergency vehicles such as fire engines, ambulances and rescue vehicles to vent hazardous engine exhaust away from a vehicle storage facility such as fire stations, garages, etc. In known prior art systems, an exhaust hose is connected to the vehicle tailpipe and an exhaust fan, connected to the exhaust hose is manually energized to exhaust fumes from the vehicle tailpipe through the exhaust ventilation system of the vehicle storage facility. Such a system and similar systems are available from Nederman, Inc. of Westland, Mich., and from other manufacturers.

In the known prior art systems, when an emergency vehicle, such as a fire truck, leaves the vehicle storage facility, such as a fire station, the direct source exhaust gas capture system must be manually energized by either actuating a switch or closing a valve to engage the exhaust fan and exhaust fumes through the exhaust hose attached to the vehicle tailpipe. It is desired to do this prior to starting the emergency vehicle, but in quick response cases, this is not always the case. When the emergency vehicle returns to the fire station, the exhaust hose must be re-attached to the vehicle tailpipe and the direct source exhaust gas capture system must again be manually actuated. It is desirable to have the direct source exhaust gas capture system running prior to the vehicle entering the fire station. With manual actuation of the direct source exhaust gas capture system, this is not always the case.

Known direct source exhaust gas capture systems also utilize pressure switches in the exhaust hose which actuate the exhaust fan of the direct source exhaust gas capture system when the exhaust hose is connected to the tailpipe of the vehicle and a differential pressure switch senses the pressure of the vehicle exhaust. Such systems suffer from the disadvantage that the engine must be running prior to the pressure switch sensing a pressure to actuate the exhaust fan. Hence, when the engine is running, such as when the vehicle returns to the fire station, the operator, who connects the exhaust hose to the tailpipe of the vehicle, is required to place the exhaust hose which is not exhausting over the tailpipe and in the process inhales hazardous exhaust fumes.

The present invention overcomes the disadvantages associated with the prior art direct source exhaust gas capture systems by automatically actuating the exhaust fan of the direct source exhaust gas capture system when the ignition system of the vehicle is turned on and prior to the engine starting and by automatically re-actuating the system when the emergency vehicle returns to its home station and is within a predetermined range of the vehicle storage facility.

SUMMARY OF THE INVENTION

The present invention provides a direct source exhaust gas capture system for capturing and exhausting exhaust fumes from a vehicle tailpipe which automatically starts when the ignition switch of the vehicle is actuated prior to the engine starting, and which is operable to automatically restart when the emergency vehicle returns to the vehicle storage facility.

The present invention provides a new and improved direct source exhaust gas capture system for capturing and exhausting exhaust fumes from a vehicle tailpipe of a vehicle having an engine, including an exhaust duct for exhausting fumes from the vehicle tailpipe, an exhaust fan connected to the duct for exhausting fumes from the vehicle tailpipe therethrough, means for energizing the exhaust fan, a receiver connected to the means for energizing the exhaust fan, and being responsive to a first signal to actuate the means for energizing the exhaust fan to energize the exhaust fan, and a transmitter associated with the vehicle for generating the first signal when the vehicle is started.

The present invention further provides a direct source exhaust gas capture system as set forth in the preceding paragraph wherein the transmitter transmits the first signal to the receiver to energize the exhaust fan prior to starting the engine of the vehicle.

A further provision of the present invention is to provide a direct source exhaust gas capture system for capturing exhaust fumes from a vehicle tailpipe when the vehicle is running and located at a vehicle storage facility, including an exhaust duct for exhausting fumes from the vehicle tailpipe, an exhaust fan connectable to the duct for exhausting fumes from the vehicle tailpipe through the duct, means for energizing the exhaust fan, a transmitter associated with the vehicle for generating a first signal when the engine of the vehicle is running, and a receiver for actuating the means for energizing the exhaust fan in response to the receiver receiving the first signal. The transmitter generates the first signal upon starting of the vehicle, and continuously generates the first signal when the vehicle is running to effect energization of the exhaust fan when the vehicle is within a predetermined range of the receiver.

Still another provision of the present invention is to provide a direct source exhaust gas capture system as set forth in the preceding paragraph wherein the transmitter has a predetermined range and the receiver is within the predetermined range when the vehicle is adjacent to the storage facility to thereby energize the exhaust fan whenever the vehicle returns to the vehicle storage facility with the engine running after being away from the vehicle storage facility.

Still another provision of the present invention is to provide a new and improved method for actuating a direct source exhaust gas capture system including the steps of sequentially actuating the ignition system of the vehicle to a first condition in which the electrical system of the vehicle is initially energized, transmitting a first signal in response to the energization of the vehicle electrical system, receiving the first signal at the direct source exhaust gas capture system, energizing the direct source exhaust gas capture system in response to receipt of the first signal, and actuating the ignition system of the vehicle to a second condition in which the starter of the vehicle is energized to start the engine of the vehicle whereby the engine of the vehicle is started after the direct source exhaust gas capture system is energized to thereby insure that exhaust is exhausted by the direct source exhaust gas capture system to the exterior of a vehicle storage facility.

Still another provision of the present invention is to provide a new and improved method of actuating a direct source exhaust gas capture system, including the steps of transmitting a limited range first signal from the vehicle when the electrical system of the vehicle is energized, receiving the first signal at the direct source exhaust gas capture system only when the direct source exhaust gas capture system is within the limited range of the vehicle, and energizing the direct source exhaust gas capture system in response to receiving the first signal and before the vehicle enters the vehicle storage facility when the vehicle has been away from the vehicle storage facility and returns thereto.

BRIEF DESCRIPTION OF THE DRAWINGS

FIG. 3 is a schematic diagram of the transmitter and the circuitry for energizing the transmitter which are connected to the ignition system of the vehicle.

DESCRIPTION OF THE PREFERRED EMBODIMENT

Figure 1:
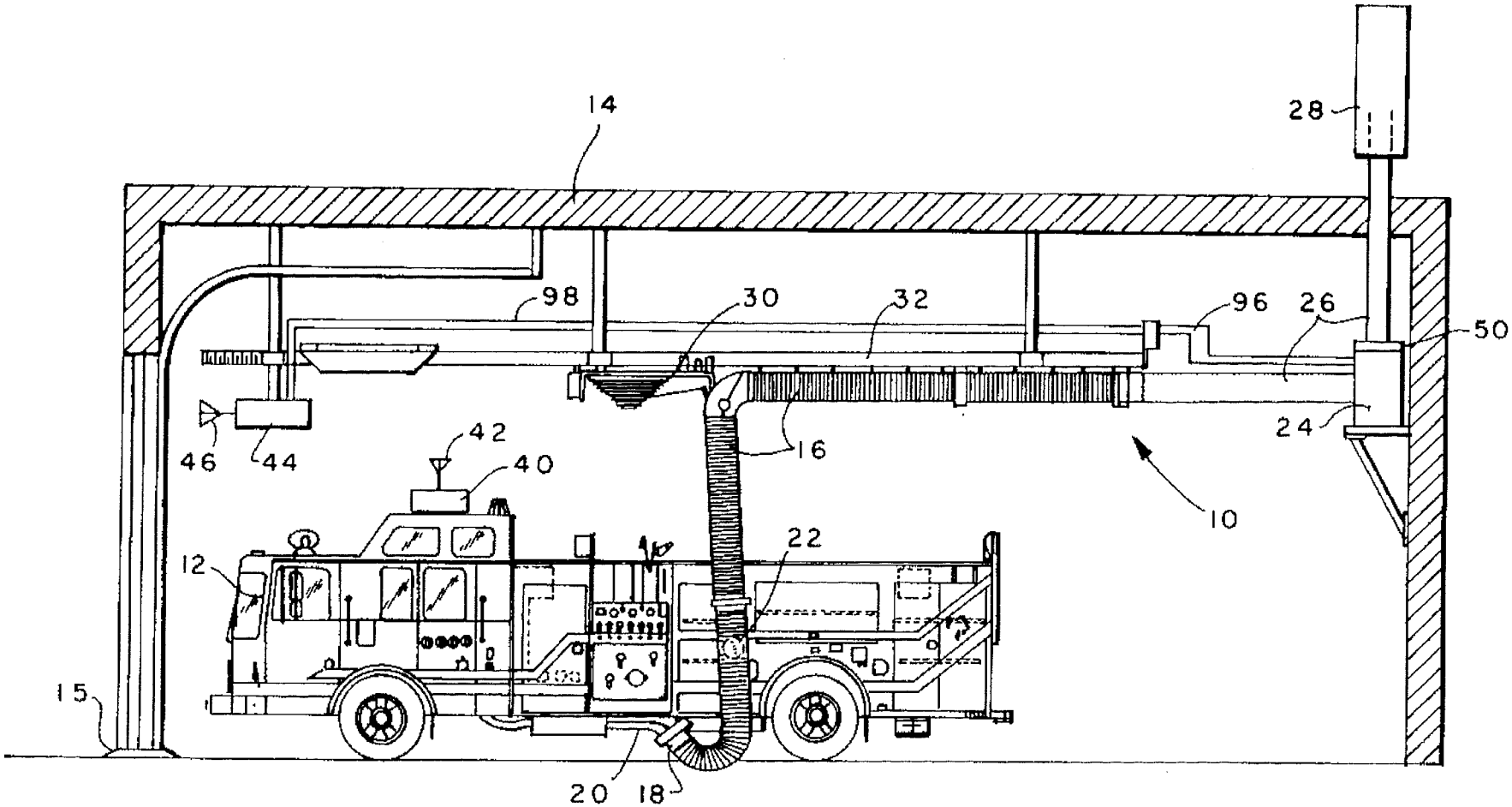
FIG. 1 is a schematic representation of the exhaust gas capture system as used in a fire station with a fire truck.

A direct source exhaust gas capture system 10 for capturing fumes from an emergency vehicle 12 is illustrated in FIG. 1. The exhaust gas capture system 10 is disclosed when used within a vehicle storage facility such as a fire station 14. The direct source exhaust gas capture system 10 operates to exhaust the engine fumes from the vehicle 12 to reduce the hazards of vehicle engine exhaust within the fire station 14. This is particularly advantageous due to the fact that emergency vehicles such as fire trucks 12 are often located within the fire station 14 in close proximity to offices, eating areas, sleeping quarters and other areas where personnel can breathe the exhaust fumes. Studies have shown that prolonged breathing of exhaust fumes and particularly diesel exhaust fumes presents a major health risk to emergency personnel. The present direct source exhaust gas capture system works equally well with diesel-powered or gasoline-powered emergency vehicles and is adapted for use in many types of vehicle storage facilities, such as fire stations and other types of vehicle depots and storage facilities.

The exhaust gas capture system 10 includes a flexible duct or hose 16 which includes a nozzle 18 at one end thereof which is designed to slip over the tailpipe 20 of the vehicle 12. The other end of the flexible hose 16 is connected to an exhaust duct 26. If desired, an electromagnet 22 can be utilized to attach the hose 16 to the vehicle 12 in well known manner to prevent the nozzle 18 from slipping off of the tailpipe 20. While a flexible duct or hose 16 has been illustrated in the preferred embodiment of the invention, other known exhaust gas capture systems utilize a manifold duct which fits around the vehicle tailpipe to exhaust gas therefrom when the vehicle is parked in the vehicle storage facility. The manifold duct fits around the vehicle tailpipe and performs the same function as the flexible hose or duct 16, is considered equivalent thereto, and the present invention can be used in either type of exhaust gas capture system.

An exhaust fan 24 is associated with the exhaust duct 26 and is adapted to exhaust through duct 26 the vehicle exhaust fumes when the hose 16 is connected to the tailpipe 20 of the vehicle 12. The exhaust duct 26 is attached to fan 24 to direct the exhaust fumes to the outside of the fire station 14 as at 28. A balancer 30 may be connected to the hose 16 to retract the hose 16 away from the vehicle 12 after the nozzle 18 is disconnected from the tailpipe 20. The hose 16 is of sufficient length such that the hose 16 will automatically disconnect from the tailpipe 20 when the vehicle 12 leaves the building 14. The balancer 30, which is spring loaded, then retracts the hose away from the vehicle after the hose is disconnected from the tailpipe 20. A track or exhaust rail 32 supports a trolley assembly (not illustrated) which in turn movably supports the hose 16 and allows the hose assembly 16 to move with the vehicle 12 while the vehicle is still inside the building 14. The electromagnet 22 is designed to be de-energized automatically as soon as the vehicle passes the threshold 15 of the door of the station, thus allowing the nozzle 18 to slip off the tailpipe 20 and the hose 16 to be retracted by the balancer 30. A suitable limit switch or switching device is associated with the direct source exhaust gas capture system 10 to automatically de-energize the electromagnet 22 when the vehicle 12 leaves the station 14 as will be more fully described below. The operation of the direct source exhaust gas capture system 10 as has been previously described is well known and such systems are available from Nederman, Inc. of Westland, Mich. While a direct source exhaust gas capture system 10 has been illustrated as of the type manufactured by Nederman, Inc. of Westland, Mich., it should be realized that the method and apparatus of the present invention can be used with other types of direct source exhaust gas capture systems manufactured by other manufacturers and can be used to retrofit existing direct source exhaust gas capture systems. For example, other known systems use an exhaust manifold duct to capture exhaust fumes from the vehicle tailpipe instead of the hose 16 disclosed herein, and it is within the scope of applicant's invention to use a manifold rather than the hose 16 illustrated to capture the exhaust fumes.

A transmitter 40, having an antenna 42, is schematically illustrated attached to the vehicle 12. A receiver 44 having an antenna 46 is connected to a control or timer 50 via conductors 96, 98 for effecting energization of the exhaust fan 24. The transmitter 40 is connected to the ignition system 11 of the vehicle 12, more fully illustrated in FIG. 3, and is operable to be continuously energized to transmit a first signal when the ignition system 11 of the vehicle 12 is turned on to energize the electrical system of the vehicle 12. In conventional emergency vehicles, the ignition system 11 of the vehicle has a first condition in which the electrical system of the vehicle is initially energized and a second condition in which the starter system (not illustrated) of the vehicle is energized to energize the starter motor (not illustrated) and start the engine of the vehicle. It is conventional to sequentially actuate the ignition system from an off condition to its first condition and then to its second condition when it is desired to start the engine of the vehicle. Normally the ignition system 11 is energized, transmitter 40 transmits a continuous first signal, and then the engine of the vehicle is started.

The receiver 44 should be located in a position to easily receive the first signal from the transmitter 40 and is preferably located just inside the door of the fire station 14 as is illustrated in FIG. 1, but could be located in other locations. When the receiver 44 receives the first signal from the transmitter 40, the fan 24 will be energized. Energization of the transmitter 40 by the ignition system 11 of the vehicle 12 prior to the engine starting insures that the fan 24 is started prior to the engine of the vehicle being started. This allows the fan 24 to be running at full RPMs prior to the engine running. By actuating the fan prior to starting the engine, the exhaust system is kept cleaner due to less deposit buildup inside the exhaust system and the operator and personnel adjacent to the vehicle are protected from exhaust fume contaminates as the fan is automatically energized prior to starting of the vehicle to thereby be effective to exhaust fumes as soon as the engine starts.

Figure 2:
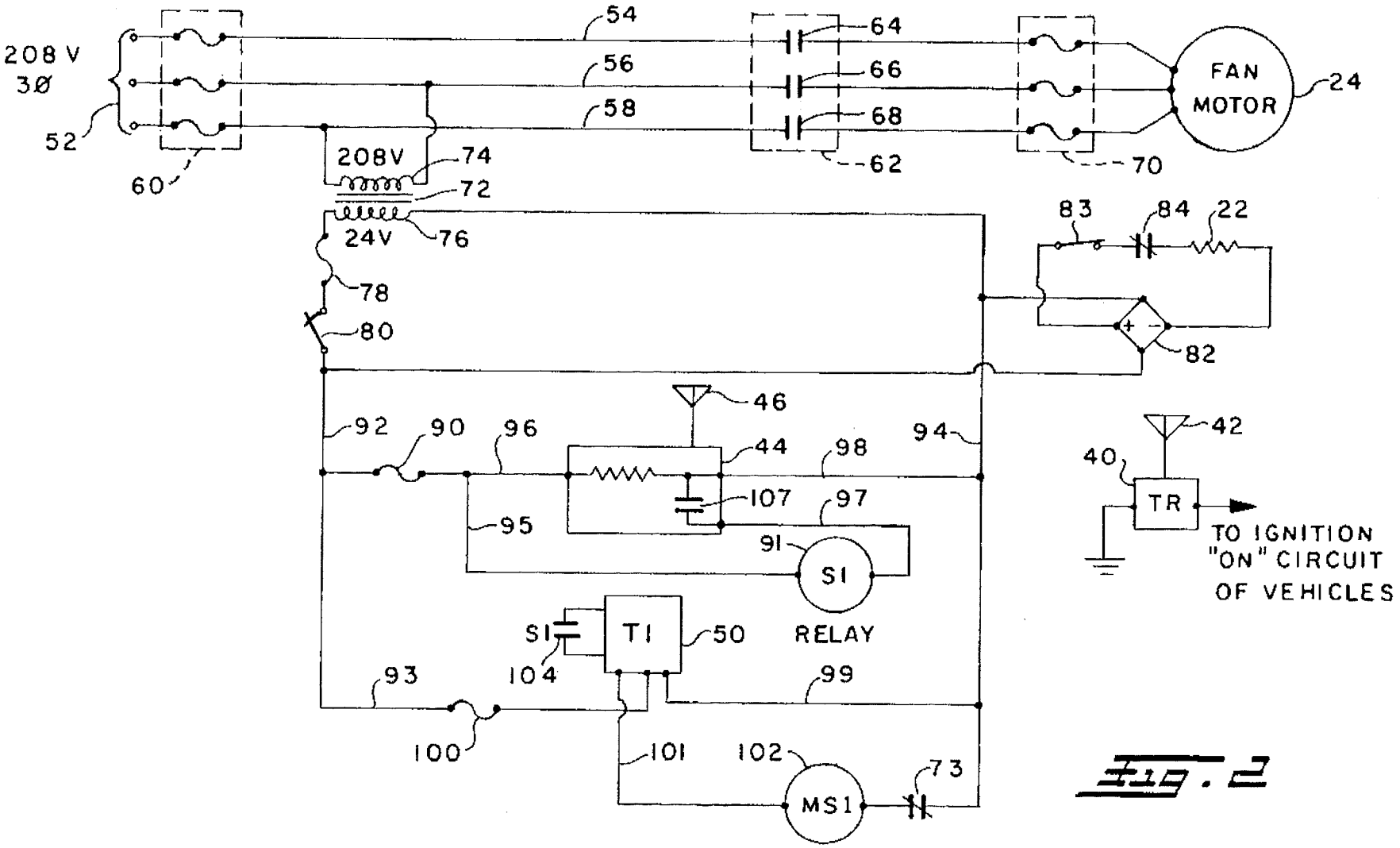
FIG. 2 is a schematic control diagram of the electrical controls for energizing the exhaust fan of the direct source exhaust gas capture system.
Figure 5:
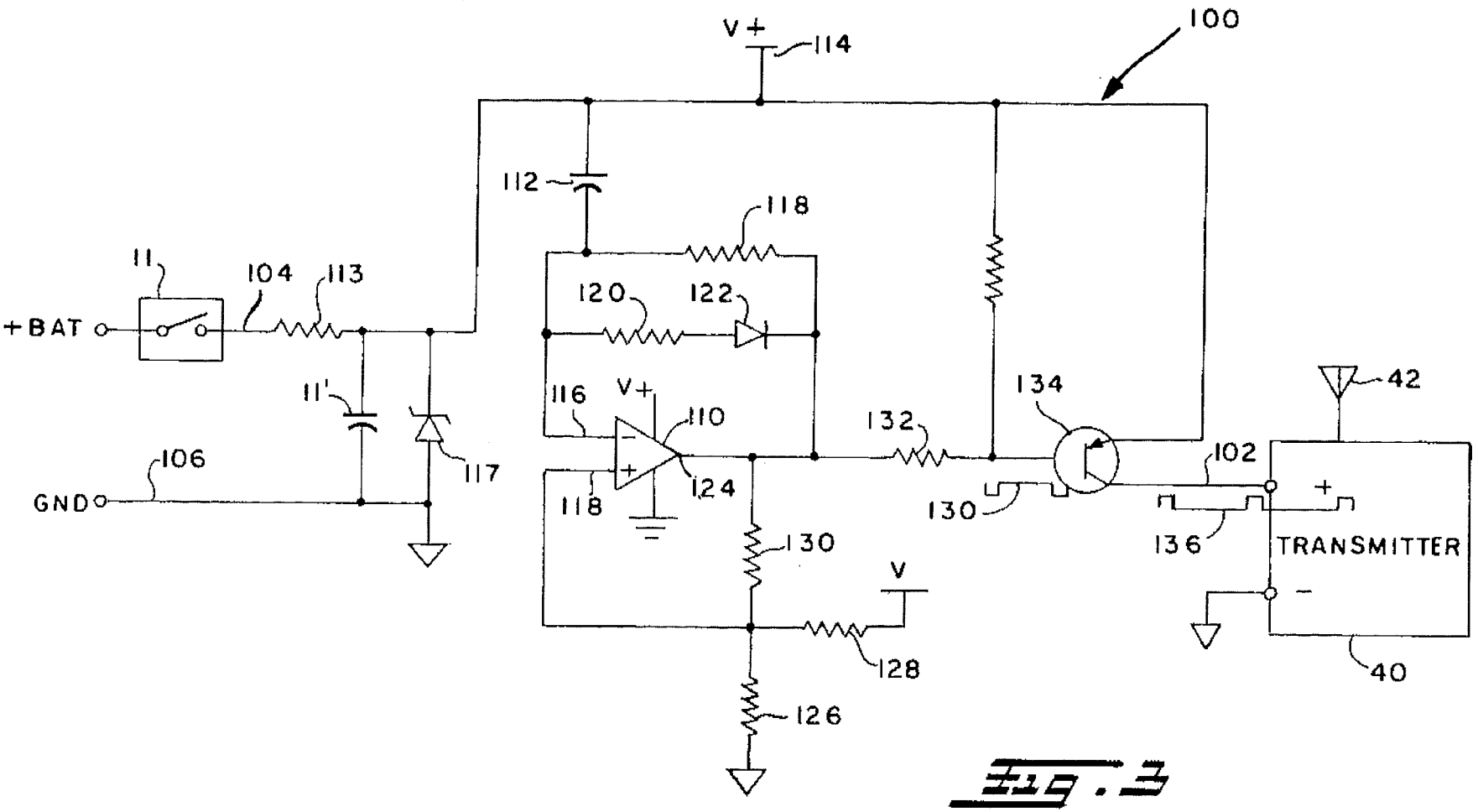

A control or timer circuit 50, more fully illustrated in FIG. 2, energizes the exhaust fan 24 for a predetermined period of time and then automatically shuts off the exhaust fan 24 when the timer 50 times out. If the transmitter 40 is within range of the receiver 44, the timer circuit 50 will be continuously reactuated by the first signal from the transmitter 40 and the timer 50 will not be allowed to time out and turn off exhaust fan 24. When the vehicle 12 leaves the fire station 14 and the receiver 44 is no longer within range of the transmitter 40, the receiver 44 will no longer receive the first signal from the transmitter 40 and the timer circuit 50 will time out to turn off exhaust fan 24. When the vehicle returns to the station 14, the transmitter 40 will be continuously transmitting and will again actuate the receiver 44 when the receiver 44 comes within range of the transmitter 40. Actuation of the receiver 44 will again actuate the control or timing circuit 50 to re-energize exhaust fan 24.

It is desirable that the transmitter 40 have a range of sufficient distance such that when the vehicle 12 returns to the fire station 14, the receiver 44 receives the first signal from transmitter 40 prior to the vehicle 12 pulling into the station 14. This allows the exhaust fan 24 of the direct source exhaust gas capture system 10 to be re-energized prior to the vehicle 12 pulling into the station 14. Emergency vehicles 12 are backed into the station 14 or slowly pulled therein which allows the exhaust fan 24 to be energized by the first signal from the continuously transmitting transmitter 40 prior to the vehicle 12 entering the station 14. The exhaust fan 24 automatically re-starts before the vehicle re-enters the station and prior to an operator attaching the hose 16 to the tailpipe 20 of the vehicle. Since the exhaust fan 24 is at full RPMs, the hose 16 and nozzle 18 will tend to act as a vacuum pulling the exhaust fumes from the tailpipe of the running vehicle into the direct source exhaust gas capture system 10 as the nozzle 18 is reattached to tailpipe 20 by an operator, thereby minimizing any exposure of the operator to engine exhaust.

Referring to FIG. 2, the electrical controls for controlling the direct source exhaust gas capture system 10 are more fully illustrated. The exhaust fan 24 is energized from a three-phase power source 52 via conductors or lines 54, 56 and 58, although other power sources such as single phase could be used. A circuit breaker or fused disconnect 60 is provided on conductors 54, 56 and 58 between the exhaust fan 24 and the three-phase power supply 52. A motor starter 62, having normally open contacts 64, 66 and 68 is disposed in lines 54, 56 and 58. The motor starter includes a starter coil 102 which is adapted to be energized by timer 50 to close contacts 64, 66 and 68 to energize the fan 24. An overload relay 70, having normally closed contacts 73, is series connected on lines 54, 56 and 58 between the motor starter 62 and the fan motor 24.

A stepdown transformer 72 includes a primary 74 which is connected across conductors 56 and 58 and a secondary 76 to provide a 24 volt AC or DC power supply for energizing the receiver 44, the receiver's associated control circuitry, such as timer 50, and the electromagnet 22. The secondary 76 of transformer 72 is series connected to conductor 94 and through a fuse 78 and a normally closed toggle switch 80 to a line 92 and to a rectifier circuit 82 which energizes the electromagnet 22. Normally closed switch 80 is a service disconnect which can be used to de-energize the receiver 44 and its associated control circuitry to allow work to be performed on various components thereof. Normally closed contacts 84 are associated with a limit switch (not illustrated) which is connected to the trolley assembly which supports hose 16 on track 32 and which opens contacts 84 and de-energizes the electromagnet 22 as the vehicle 12 exits the station 14 and the hose 16 and trolley assembly moves along the track 32 to a predetermined position at which the limit switch is actuated. A toggle switch 83 which is series connected with the electromagnet 22 is normally closed and can be utilized to manually actuate and de-actuate the electromagnet 22.

Receiver 44 is connected in series with fuse 90 across power conductors 92 and 94 which are connected to the secondary 76 of the transformer 72. The receiver 44 is connected via lines 96 and 98 to conductors 92 and 94 and is continuously powered.

The timer 50 is also continuously energized via lines 93 and 99 which are also connected to power conductors 92 and 94 and includes a fuse 100 series connected to the timer 50 in line 93. A pair of normally open contacts 104, which are associated with an isolated start relay 91, are connected to timer 50. The start relay 91 is energized by line 95 and is connected to the receiver 44 by line 97. When the receiver receives a first signal from the transmitter 40, contacts 107 associated with receiver 44 will close to complete a circuit, though the start relay 91 and start relay contacts 104 will close to energize the timer 50. Timer 50 effects energization of the exhaust fan 24 for a predetermined time period before the timer 50 times out. When receiver 44 no longer receives the first signal from the transmitter 40, the start relay 91 will be de-energized and contacts 104 will open. The timer 50 is reset each time receiver 44 receives the first signal from transmitter 40. In the preferred embodiment, the timer 50 has a timing cycle of 3 minutes and is periodically reset by the receiver 44 receiving the first signal when transmitter 40 is transmitting and is within range of the receiver 44. The timer does not time out as long as receiver 44 continues to receive the first signal. The output of the timer 50 is connected to a motor starter 102 via line 101. When the motor starter is energized it closes contacts 64, 66 and 68 to energize the fan 24. An overload relay 70 and its normally closed contacts 73 function in a well-known manner to provide overload protection to the motor of the fan 24.

The transmitter 40, more fully illustrated in FIG. 3, can be a transmitter such as utilized to open garage doors, and in the preferred embodiment, is a GPT90-1 model transmitter manufactured by Genie Company of Alliance, Ohio. In the preferred embodiment, the transmitter 40 and its associated circuitry is continuously energized to transmit a first signal which is periodic. Antenna 42 may be located internally of the transmitter 40 but is disclosed schematically as outside the transmitter 40 for clarity.

A timing circuit 100 is connected to the input 102 of the transmitter 40 to turn the transmitter 40 on and off at a predetermined periodic rate. The timing circuit 100 is connected to the battery and the ignition system 11 of the vehicle via the power conductors 104 and ground 106 and is continuously energized whenever the ignition switch is turned to its on position. Thus, timer circuit 100 is energized immediately upon starting of the vehicle 12 when the ignition switch is turned to its on position and prior to the ignition switch moving to its start position to engage the starter to energize the engine of the vehicle.

One comparator 110 from a dual comparator chip, such as an LM 393, can be utilized to form an oscillator for the timing circuit 100. A capacitor 111, resistor 113, and zenor diode 117 form a regulated power supply for the timer circuit which energizes the transmitter 40. A capacitor 112 is connected to the input terminal 116 of the comparator 110, and it is also connected to the 9 volt voltage source. Connection of the capacitor 112 to the voltage source insures that the input 116 is connected to the positive supply V+ when the timer circuit 100 is initially energized. A resistor 118 is series connected with the capacitor 112 to an output 124 of the comparator 110. A resistor 120, which is series connected to a diode 122, is also connected to the capacitor 112 and the output 124 of the comparator 110. The resistor 118 and series circuit of resistor 120 and diode 122 control the rate of charging and discharging of the capacitor 112 and thus the oscillation rate of the timing circuit 100.

Resistors 126, 128 and 130 generate a voltage which follows the output of comparator 110 to set input 118 at 3 or 6 volts. When the output of comparator 110 is high, the voltage at 118 is 6 volts. When the output of the comparator 110 is low, the voltage at 118 is 3 volts. The voltage at input 116 of comparator 110 follows the voltage on capacitor 112 as the capacitor charges and discharges between 3 and 6 volts to provide high and low signals to the input 116 of the comparator 110. The output of the comparator 110 oscillates between 0 volts and 9 volts to form the periodic pulse train, schematically illustrated at 130, which is directed through a resistor 132 to the base of transistor 134. The output of transistor 134 on line 102 is also a periodic pulse train, schematically illustrated at 136, which periodically actuates the transmitter 40. While the transmitter 40 is periodically turned on and off via the output of transistor 134 in the timing circuit 100, the timing circuit 100 and transmitter 40 are being characterized herewith as being continuously energized when the ignition switch of the vehicle is in its on position even though in fact the transmitter 40 is turned on and off, i.e. the transmitter 40 continuously transmits a first signal which is periodic. Additionally, the first signal output of the transmitter 40 is characterized as being continuous, i.e. a continuous periodic waveform.

When the ignition switch is initially energized, capacitor 112 is charged positive due to its connection to the positive voltage source at 114. This insures that the output 124 of comparator 110 is low. The low pulse is directed to the base of transistor 134 to insure a high output from transistor 134 at its collector at 102 to energize the transmitter 40 when the ignition switch is initially turned to its on position. This insures that the fan motor 24 is energized prior to starting the engine. Capacitor 112 discharges through resistor 120 and diode 122. Resistor 120 is much smaller than resistor 118 which controls the charging of capacitor 112 after its initial discharge. Resistor 120 is sized much smaller than resistor 118, so that the on pulse of the periodic signal to transmitter 40 will be much shorter in duration than the off pulse. In the preferred embodiment, the transmitter 40 has an output which is on for 0.3 seconds and then off for 11 seconds. The short on period and long off period allows the periodic output of the transmitter to comply with FCC regulations. When capacitor 112 is discharged, the input 116 to comparator 110 goes low, the output from comparator 110 at 124 goes high, to turn off transistor 134. When transistor 134 is off, a low input is provided to transmitter 40 to thereby turn off transmitter 40. The output from the comparator 110 will be periodic, in the preferred embodiment 0.3 seconds low and 11 seconds high, as long as the ignition switch of the vehicle is in its on condition and the electrical system of the vehicle is energized. Thus, as long as the engine is running, transmitter 40 will provide a continuous periodic pulse train or first signal which can be received by the receiver 44. The period of the transmitter 40 must be shorter than the time out period of the timer 50 to allow the timer 50 to be continuously reset when the transmitter 40 is within range of the receiver 44. The timer 50 is not allowed to time out and de-energize the exhaust fan 24 when the receiver 44 is within range of the transmitter 40.

As soon as the receiver 44 receives a pulse from the transmitter 40, the timer circuit 50 is energized to effect actuation of the motor starter 102 and energization of the fan 24. In practice, the vehicle 12 will be located in the station 14 with the exhaust hose 16 attached to the tailpipe 20 of the vehicle 12. When an operator attempts to start the vehicle 12, the ignition switch will move to a first condition or on position which will effect energization of the transmitter 40. Transmitter 40 will send the first signal to the receiver 44 and start the fan 24 to exhaust fumes from the vehicle tailpipe 20. The fan 24 will be started prior to starting of the engine of the vehicle. The engine on the vehicle will then be started by moving the ignition switch to a second condition or start position and the exhaust fumes will be pulled from the tailpipe 20 through the exhaust hose 16 by the fan 24 to the exhaust duct 26 where they will exit the building at 28.

The transmitter 40 will continue to provide a periodic signal to the receiver 44 to continually re-actuate timer 50. As the vehicle 12 exits the building 14, the electromagnet 22 will be de-energized, the nozzle 18 will slip off of the tailpipe 20 and the hose 16 will be retracted by the balancer 30. As the vehicle 12 moves away from the building 14, the receiver 44 will no longer be in range of the transmitter 40 and the timer circuit 50 will then time out to de-energize motor starter 102, open contacts 64, 66 and 68, and stop fan motor 24.

When the vehicle returns to the station 14, the receiver 44 will again be within range of transmitter 40 which continues to transmit due to the fact that the ignition switch is in its on position and the vehicle 12 is running. When the receiver 44 comes within range of the transmitter 40, the vehicle 12 will still preferably be outside of the station 14. The receiver 44 will then again receive the first signal from the transmitter and energize the timing circuit 50 to energize motor starter 102 and start the fan motor 24. As the vehicle 12 approaches the threshold 15 of the building 14, the fan 24 will be running at full RPM and an operator can then manually reattach the nozzle 18 of hose 16 to the tailpipe 20 as the vehicle 12 enters the building 14. By having fan 24 running at full RPM prior to attaching the hose 16 to the vehicle tailpipe 20, the exposure of the operator who manually attaches the hose to the tailpipe is minimized.

The transmitter 40 preferably has a range of 30'–40'. The limited range along with the periodic output of the transmitter 40 prevents spurious actuation of the receiver 44 such as might occur if a vehicle equipped with the transmitter 40 were to drive down a street in front of the building 14 where the receiver 44 is located. When the vehicle 12 is returned to the vehicle storage facility 14, it generally takes some time to maneuver the vehicle 12 into its allocated parking space. During this maneuvering time the transmitter 40 which is now within range of receiver 44 periodically transmits to insure that the fan 24 is energized prior to the vehicle entering the building 14.

From the foregoing it should be apparent that a new and improved direct source exhaust gas capture system and method of actuating a direct source exhaust gas capture system has been provided for capturing and exhausting exhaust fumes from a vehicle tailpipe when the vehicle is located at a vehicle storage facility 14. The direct source exhaust gas capture system 10 includes an exhaust gas hose 16 for attaching to a vehicle tailpipe 20 when the vehicle is located at the storage facility 14, an exhaust fan 24 connected to the hose 16 for exhausting exhaust fumes from the vehicle tailpipe 20 through the hose 16 when the fan 24 is energized, control means such as timer 50 for energizing the exhaust fan, a transmitter 40 connected to the vehicle for generating a first signal when the vehicle is running, and a receiver 44 for actuating the timer 50 to energize the exhaust fan 24 in response to the receiver 44 receiving the first signal from the transmitter 40. The transmitter 40 generates the first signal upon starting of the vehicle and continually generates the first signal when the vehicle is running. The receiver 44 is responsive to the first signal when the transmitter means is within a predetermined range of the receiver to actuate the timing circuit 50 to energize the exhaust fan 24 to exhaust fumes from the vehicle tailpipe 20 when the hose 16 is attached thereto.

What we claim is:

1. A direct source exhaust gas capture system for capturing and exhausting exhaust fumes from a vehicle tailpipe of a vehicle having an engine, comprising an exhaust duct for capturing exhaust fumes from the vehicle tailpipe, an exhaust fan connected to said duct for exhausting fumes from the vehicle tailpipe through said duct, means for energizing said exhaust fan, receiver means connected to said means for energizing said exhaust fan, said receiver means being adapted to receive a first signal to actuate said means for energizing said exhaust fan to energize said exhaust fan to exhaust fumes from the vehicle tailpipe, and transmitter means connectable to the vehicle, said transmitter means being energized upon starting of the vehicle to transmit said first signal to said receiver means and thereby energize said exhaust fan.

2. A direct source exhaust gas capture system as defined in claim 1 wherein said transmitter means is operable to transmit said first signal to said receiver means prior to starting of the engine of the vehicle to thereby energize said exhaust fan prior to the starting of the engine of the vehicle.

3. A direct source exhaust gas capture system as defined in claim 2 wherein said vehicle includes an ignition system, and said transmitter means is connected to said ignition system of the vehicle and is energized to transmit said first signal prior to the starting of the engine of the vehicle.

4. A direct source exhaust gas capture system for capturing and exhausting exhaust fumes from a vehicle tailpipe of a vehicle having an engine, comprising an exhaust duct for capturing exhaust fumes from the vehicle tailpipe, an exhaust fan connected to said duct for exhausting fumes from the vehicle tailpipe through said duct, means for energizing said exhaust fan, receiver means connected to said means for energizing said exhaust fan, said receiver means being adapted to receive a first signal to actuate said means for energizing said exhaust fan to energize said exhaust fan to exhaust fumes from the vehicle tailpipe, and transmitter means connectable to the vehicle, said transmitter means being energized upon starting of the vehicle to transmit said first signal to said receiver means and thereby energize said exhaust fan, and wherein said transmitter means is continuously energized when the engine of the vehicle is running.

5. A direct source exhaust gas capture system for capturing and exhausting exhaust fumes from a vehicle tailpipe of a vehicle having an engine, comprising an exhaust duct for capturing exhaust fumes from the vehicle tailpipe, an exhaust fan connected to said duct for exhausting fumes from the vehicle tailpipe through said duct, means for energizing said exhaust fan, receiver means connected to said means for energizing said exhaust fan, said receiver means being adapted to receive a first signal to actuate said means for energizing said exhaust fan to energize said exhaust fan to exhaust fumes from the vehicle tailpipe, and transmitter means connectable to the vehicle, said transmitter means being energized upon starting of the vehicle to transmit said first signal to said receiver means and thereby energize said exhaust fan, said transmitter means being operable to transmit said first signal to said receiver means prior to starting of the engine of the vehicle to thereby energize the exhaust fan prior to the starting of the engine of the vehicle, and wherein said vehicle includes an ignition system and said transmitter means is connected to said ignition system of the vehicle and is energized to transmit said first signal prior to the starting of the engine of the vehicle, and said transmitter means is continuously energized when the engine of the vehicle is running.

6. A direct source exhaust gas capture system as defined in claim 4 wherein said first signal transmitted by said transmitter means is a periodic signal having an on portion and an off portion, and said transmitter means continuously transmits said first signal when the engine of the vehicle is running.

7. A direct source exhaust gas capture system as defined in claim 5 wherein said first signal is a periodic signal having an on portion and an off portion, and said transmitter means continuously transmits said first signal when the engine of the vehicle is running.

8. A direct source exhaust gas capture system as defined in claim 6 wherein said receiver means is adapted to periodically receive said on portion of said first signal transmitted by said transmitter means when said transmitter means is within a predetermined range of said receiver means.

9. A direct source exhaust gas capture system as defined in claim 8 wherein said transmitter means is operable to initially generate said on portion of said first signal when the vehicle is initially started.

10. A direct source exhaust gas capture system as defined in claim 7 wherein the vehicle ignition system is operable to sequentially energize said transmitter means and then start the engine of the vehicle when the ignition system is initially actuated.

11. A direct source exhaust gas capture system as defined in claim 10 wherein said transmitter means is operable to initially generate said on portion of said first signal when said transmitter means is energized upon the ignition systems being initially actuated, said receiver means is adapted to receive said on portion of said first signal to thereby effect energization of said exhaust fan before the vehicle is started.

12. A direct source exhaust gas capture system as defined in claim 1 further including a timer circuit connected to said exhaust fan, said means for energizing said exhaust fan, and said timer circuit energizing said exhaust fan in response to said receiver means receiving said first signal for a predetermined period of time and then de-energizing said exhaust fan.

13. A direct source exhaust gas capture system as defined in claim 6 further including a timer circuit connected to said exhaust fan and said means for energizing said exhaust fan, said timer circuit energizing said exhaust fan in response to said receiver means receiving said first signal for a predetermined period of time and then de-energizing said exhaust fan, said timer circuit being actuated by said receiver means receiving said signal on portion of said first signal and effecting energization of said exhaust fan for a predetermined period which is greater than the period of said first signal to thereby effect continuous energization of said exhaust fan when said transmitter means is continuously transmitting and within a predetermined range of said receiver means.

14. A direct source exhaust gas capture system as defined in claim 13 wherein said timer circuit de-energizes said exhaust fan upon expiration of said predetermined period when said transmitter means is not within said predetermined range of said receiver means.

15. A direct source exhaust gas capture system for capturing exhaust fumes from a vehicle tailpipe of a vehicle having an engine when the engine of the vehicle is running and located at a vehicle storage facility comprising an exhaust duct for capturing exhaust fumes from the vehicle tailpipe when the vehicle is located at the vehicle storage facility, an exhaust fan connected to said exhaust duct for exhausting fumes from the vehicle tailpipe through said duct when said fan is energized, means for energizing said exhaust fan, transmitter means associated with the vehicle for generating a first signal when the engine of the vehicle is running, and receiver means responsive to receipt of said first signal for actuating said means for energizing said exhaust fan, said transmitter means continuously generating said first signal when the engine of the vehicle is running, said receiver means being responsive to said first signal when said transmitter means is within a predetermined range of said receiver means to actuate said means for energizing said exhaust fan to energize said exhaust fan to exhaust fumes from the vehicle tailpipe through said exhaust duct.

16. A direct source exhaust gas capture system as defined in claim 15 wherein said transmitter means has a predetermined range and said receiver means is within said predetermined range when the vehicle is adjacent to the vehicle storage facility to thereby energize said receiver means and actuate said exhaust fan whenever the vehicle returns to the vehicle storage facility with the engine running after being away from the vehicle storage facility.

17. A direct source exhaust gas capture system as defined in claim 16 wherein said transmitter means transmits said first signal to effect energization of said exhaust fan prior to the vehicle entering the vehicle storage facility upon return of the vehicle with the engine running to the vehicle storage facility.

18. A direct source exhaust gas capture system as defined in claim 16 wherein said transmitter means is connected to the ignition system of the vehicle and generates said first signal when the ignition system is energized prior to the engine of the vehicle starting, to thereby energize said exhaust fan prior to the starting of the engine of the vehicle.

19. A direct source exhaust gas capture system as defined in claim 18 wherein said transmitter means is continuously energized when the engine of the vehicle is running.

20. A direct source exhaust gas capture system as defined in claim 19 wherein said first signal transmitted by said transmitter means is a periodic signal having an on portion and an off portion.

21. A direct source exhaust gas capture system as defined in claim 20 wherein said receiver means is adapted to periodically receive said on portion of said first signal from said transmitter means when said transmitter means is within said predetermined range of said receiver and the engine of the vehicle is running.

22. A direct source exhaust gas capture system as defined in claim 20 wherein said on portion of said periodic signal is extended for the initial period of said periodic first signal upon initial energization of said transmitter means to thereby insure that said receiver means receives said on portion of said first signal.

23. A direct source exhaust gas capture system as defined in claim 22 wherein said transmitter means is operable to initially generate said on portion of said first signal upon initial energization of said transmitter means when the engine of the vehicle is initially started.

24. A direct source exhaust gas capture system as defined in claim 18 wherein the vehicle ignition system is actuated to sequentially energize said transmitter means and then start the engine of the vehicle when the ignition system is initially actuated.

25. A direct source exhaust gas capture system as defined in claim 24 wherein said transmitter means is operable to initially generate said on portion of said first signal when said transmitter means is energized upon the ignition system being initially actuated to thereby effect energization of said exhaust fan before the engine is started.

26. A direct source exhaust gas capture system as defined in claim 15 further including a timer circuit connected to said exhaust fan and said means for energizing said exhaust fan, said timer circuit energizing said exhaust fan in response to said receiver means receiving said first signal for a predetermined period of time and then de-energizing said exhaust fan.

27. A direct source exhaust gas capture system as defined in claim 20 further including a timer circuit connected to said exhaust fan and said means for energizing the exhaust fan, said timer circuit, in response to said receiver means receiving said first signal, energizing said exhaust fan for a predetermined period of time, said timer circuit being actuated by said receiver receiving said on portion of said first signal and effecting energization of said exhaust fan for a predetermined period which is greater than the period of said first signal to thereby effect continuous energization of said exhaust fan when said transmitter means is continuously transmitting and within a predetermined range of said receiver means.

28. A direct source exhaust gas capture system as defined in claim 27 wherein said timer circuit de-energizes said exhaust fan upon expiration of said predetermined period of time when said transmitter means is not within said predetermined range of said receiver means.

29. A method of actuating a direct source exhaust gas capture system which includes a controller, an exhaust fan and ducting for capturing exhaust from the tailpipe of a vehicle in a vehicle storage facility wherein the vehicle includes an ignition system which is actuatable to a first condition to energize the electrical system of the vehicle and a second condition to energize the starting system of the vehicle, comprising the steps of sequentially:

actuating the ignition system of the vehicle to the first condition in which the electrical system of the vehicle is initially energized;

transmitting a first signal in response to energization of the vehicle electrical system;

receiving said first signal at the controller of the direct source exhaust gas capture system;

energizing the exhaust fan of the direct source exhaust gas capture system in response to receipt of said first signal by the controller; and actuating the ignition system of the vehicle to a second condition in which the starter of the vehicle is actuated to start the engine of the vehicle whereby the engine of the vehicle is started after the exhaust fan is energized to thereby insure that exhaust is exhausted by the exhaust fan from the vehicle tailpipe through the ducting to the exterior of the vehicle storage facility.

30. A method of actuating a direct source exhaust gas capture system as defined in claim 29 wherein said step of transmitting said first signal includes the step of transmitting said first signal from the vehicle.

31. A method of actuating a direct source exhaust gas capture system as defined in claim 29 wherein said step of transmitting said first signal includes the step of continuously transmitting said first signal from the vehicle when the electrical system of the vehicle is energized.

32. A method of actuating a direct source exhaust gas capture system as defined in claim 31 wherein said step of continuously transmitting said first signal includes the step of continuously transmitting a periodic signal having an on portion and an off portion.

33. A method of actuating a direct source exhaust gas capture system as defined in claim 32 wherein said step of continuously transmitting said first signal further includes the step of transmitting for a limited range said first signal, and wherein said step of receiving said first signal is only performed when the controller of the direct source exhaust gas capture system is within a limited range of the vehicle from which the first signal is transmitted.

34. A method of actuating a direct source exhaust gas capture system as defined in claim 33 further including the step of de-energizing the exhaust fan of the direct source exhaust gas capture system after a predetermined time period after the receipt of the last to be received on portion of said periodic signal as the vehicle moves outside the limited range.

35. A method of actuating a direct source exhaust gas capture system as defined in claim 34 further including the steps of receiving said first signal at the controller of the direct source exhaust gas capture system when the vehicle again moves inside the limited range, and energizing the exhaust fan of the direct source exhaust gas capture system in response to receipt of said first signal by said controller.

36. A method of actuating a direct source exhaust gas capture system which includes a controller, an exhaust fan and ducting for capturing exhaust from the tailpipe of a vehicle having an electrical system and exhausting the exhaust through the ducting to the outside of a vehicle storage facility comprising the steps of:

continuously transmitting a limited range first signal from the vehicle when the electrical system of the vehicle is energized;

receiving said first signal at the controller of the direct source exhaust gas capture system only when the vehicle is within the limited range of the first signal which is when the vehicle is within or adjacent to the vehicle storage facility; and energizing the exhaust fan of the direct source exhaust gas capture system in response to receiving the first signal at the controller and before the vehicle enters the vehicle storage facility when the vehicle has been away from the vehicle storage facility and returns thereto.

37. A method of actuating a direct source exhaust gas capture system as defined in claim 36 wherein the step of continuously transmitting said first signal comprises the step of continuously transmitting said first signal which is a periodic signal having an on portion and an off portion.

38. A method of actuating a direct source exhaust gas capture system as defined in claim 36 wherein the step of continuously transmitting said first signal comprises the step of continuously transmitting said first signal which is a periodic signal having an on portion which is less than 10% of the duration of the off portion of the periodic signal.

39. A method of actuating a direct source exhaust gas capture system for exhausting exhaust gas from a vehicle located in a vehicle storage facility comprising the steps of sequentially: energizing the electrical system of the vehicle; transmitting a first signal in respect to energization of the vehicle's electrical system; receiving the first signal at the exhaust gas capture system; and energizing the exhaust gas capture system in response to receipt of said first signal.

40. A method of actuating a direct source exhaust gas capture system for exhausting exhaust gas from a vehicle located in a vehicle storage facility comprising the steps of sequentially: energizing the electrical system of the vehicle; transmitting a first signal in respect to energization of the vehicle's electrical system; receiving the first signal at the exhaust gas capture system; and energizing the exhaust gas capture system in response to receipt of said first signal, and wherein said step of transmitting said first signal includes the step of continuously transmitting said first signal when the electrical system of the vehicle is energized.

41. A method of actuating a direct source exhaust gas capture system, as defined in claim 40, wherein said step of continuously transmitting said first signal includes the step of continuously transmitting a periodic first signal.

42. A method of actuating a direct source exhaust gas capture system, as defined in claim 40, wherein said step of receiving said first signal at the exhaust gas capture system includes the step of receiving said first signal only when the vehicle is within a predetermined limited range of the exhaust gas capture system.

43. A direct source exhaust gas capture system for capturing and exhausting exhaust fumes from a vehicle tailpipe of a vehicle having an engine, comprising an exhaust duct for capturing exhaust fumes from the vehicle tailpipe, an exhaust fan connected to said duct for exhausting fumes from the vehicle tailpipe through said duct, means for energizing said exhaust fan, receiver means connected to said means for energizing said exhaust fan, said receiver means being adapted to receive a first signal to actuate said means for energizing said exhaust fan to energize said exhaust fan to exhaust fumes from the vehicle tailpipe, transmitter means connectable to the vehicle, said transmitter means being energized upon starting of the vehicle to transmit said first signal to said receiver means and thereby energize said exhaust fan, and wherein said transmitter means is operable to transmit said first signal to said receiver means prior to starting of the engine of the vehicle to thereby energize said exhaust fan prior to the starting of the engine of the vehicle, and said vehicle includes an ignition system, and said transmitter means is connected to said ignition system of the vehicle and is energized to transmit said first signal prior to the starting of the engine of the vehicle.

* * * * *